US009424762B2

(12) United States Patent
Peterson

(10) Patent No.: US 9,424,762 B2
(45) Date of Patent: Aug. 23, 2016

(54) CLING PRINT SYSTEM

(75) Inventor: James Peterson, Manitowoc, WI (US)

(73) Assignee: CONTEMPORARY, INC., Manitowoc, WI (US)

( * ) Notice: Subject to any disclaimer, the term of this patent is extended or adjusted under 35 U.S.C. 154(b) by 346 days.

(21) Appl. No.: 13/091,925

(22) Filed: Apr. 21, 2011

(65) Prior Publication Data

US 2011/0284404 A1 Nov. 24, 2011

Related U.S. Application Data

(60) Provisional application No. 61/326,316, filed on Apr. 21, 2010, provisional application No. 61/421,488, filed on Dec. 9, 2010.

(51) Int. Cl.

| | |
|---|---|
| ***A44C 3/00*** | (2006.01) |
| ***G09F 3/10*** | (2006.01) |
| ***G09F 3/18*** | (2006.01) |
| ***G09F 3/02*** | (2006.01) |

(52) U.S. Cl.

CPC ... *G09F 3/02* (2013.01); *A44C 3/00* (2013.01); *G09F 3/10* (2013.01); *G09F 3/18* (2013.01); *Y10T 156/1075* (2015.01); *Y10T 428/24868* (2015.01)

(58) Field of Classification Search

CPC ..... A44C 3/00; G09F 3/10; G09F 3/18; G09F 2003/0201

USPC ..... 40/626, 630, 594, 595; 283/81, 109

See application file for complete search history.

(56) References Cited

U.S. PATENT DOCUMENTS

| | | | | |
|---|---|---|---|---|
| 2,575,721 | A * | 11/1951 | Lichty | 40/620 |
| 4,190,691 | A * | 2/1980 | Kramer | 40/725 |
| 5,398,435 | A * | 3/1995 | Kanzelberger | 40/626 |
| 5,464,681 | A * | 11/1995 | Luce | 40/594 |
| 5,795,090 | A * | 8/1998 | Jackson | 283/101 |
| 5,997,683 | A * | 12/1999 | Popat | 428/43 |
| 6,173,514 | B1 | 1/2001 | Peterson | |
| 6,548,128 | B2 * | 4/2003 | Auld et al. | 428/13 |
| 6,726,252 | B1 * | 4/2004 | Chaikel et al. | 283/81 |
| 6,860,045 | B1 * | 3/2005 | Sadler et al. | 40/661 |
| 7,194,828 | B2 | 3/2007 | Peterson et al. | |
| 7,752,782 | B2 | 7/2010 | Peterson et al. | |
| 2004/0084896 | A1 | 5/2004 | Peterson | |
| 2005/0011093 | A1 * | 1/2005 | Peterson | 428/542.6 |
| 2009/0071045 | A1 | 3/2009 | Peterson | |
| 2010/0223567 | A1 | 9/2010 | Peterson et al. | |
| 2010/0242319 | A1 | 9/2010 | Peterson et al. | |
| 2011/0056100 | A1 | 3/2011 | Peterson et al. | |

* cited by examiner

*Primary Examiner* — Kyle Grabowski

(74) *Attorney, Agent, or Firm* — Michael Best & Friedrich LLP

(57) ABSTRACT

A label assembly including a label having a top surface and a bottom surface opposite the top surface, where the top surface includes indicia printed thereupon, and a layer of a first adhesive is coated on the bottom surface. The label assembly also includes a dome cover coupled to the label, the dome cover being formed of a substantially transparent material and having an underside, where a layer of a second adhesive is coated on the underside, the second adhesive having a greater holding capability than the first adhesive.

12 Claims, 13 Drawing Sheets

CLING PRINT SYSTEM

CROSS REFERENCE TO RELATED APPLICATIONS

This patent application claims priority to U.S. Provisional Patent Application No. 61/326,316, filed Apr. 21, 2010. The present patent application also claims priority to U.S. Provisional Patent Application No. 61/421,488, filed Dec. 9, 2010. Each of the above referenced applications is hereby incorporated by reference.

FIELD OF THE INVENTION

The present invention relates to a re-usable sign system.

BACKGROUND

Food buffets often include labels or other means of identification so patrons can quickly and easily identify the various food items present. Maintaining the accuracy of the labels can often be difficult, especially in situations where the menu or food selection changes on regular basis. These changes often require the owners to repeatedly re-arrange existing labels and create new labels to correspond with the updated food choices. In addition, aesthetically pleasing displays are often desired to provide a professional, clean look for the buffet.

SUMMARY

In one aspect, this invention provides a label assembly. The label assembly including a label having a top surface and a bottom surface opposite the top surface, where the top surface includes indicia printed thereupon, and a layer of a first adhesive is coated on the bottom surface. The first adhesive having a first holding capability. The label assembly also includes a dome cover coupled to the label, the dome cover being formed of a substantially transparent material and having an underside, where a layer of a second adhesive is coated on the underside, the second adhesive having a second holding capability greater than the first holding capability.

In another aspect, this invention includes a kit for creating reusable label assemblies having indicia thereon. The kit including one or more sheets of label stock, one or more dome covers, a label removal tool, one or more backing plates, and a storage apparatus.

In still another aspect, this invention includes a method of creating a reusable label assembly. The method including placing a sheet of label stock in a printing apparatus, printing indicia on the top surface of the label stock, dividing the label stock into multiple labels, obtaining a dome cover, and applying the dome cover to a top surface of a corresponding label to create a label assembly.

Figure 1:
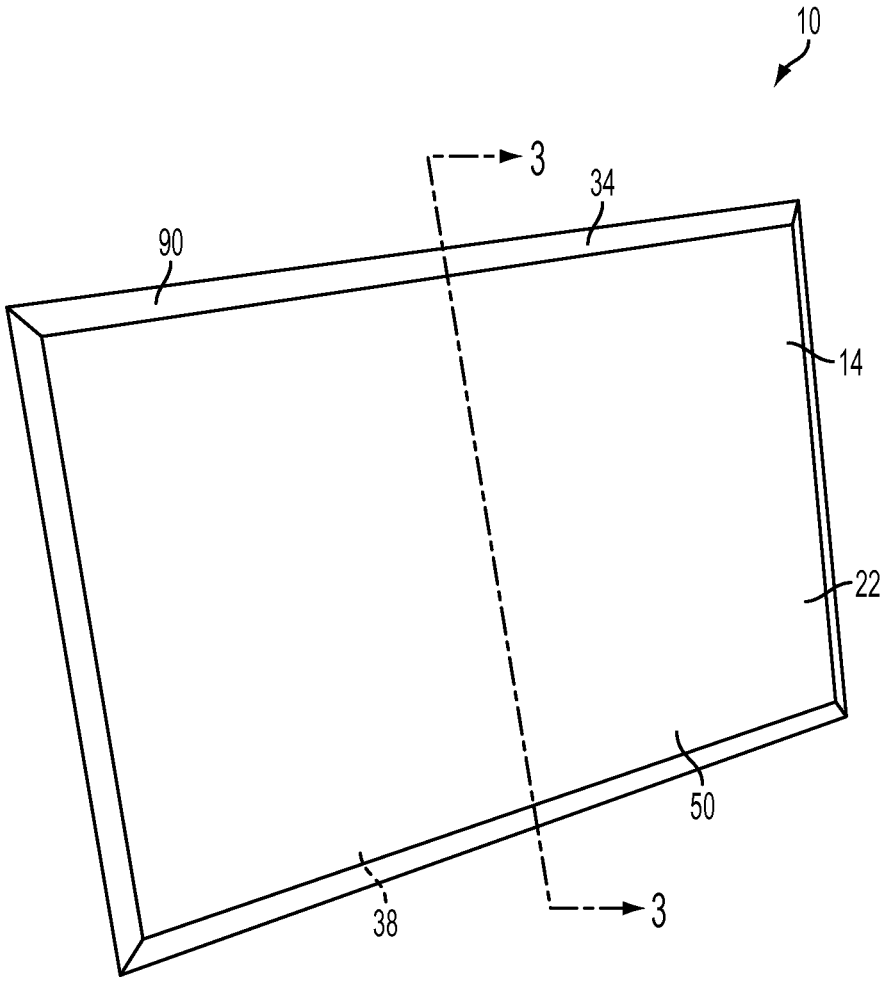
FIG. 1 is a perspective view of a label assembly placed on a backing plate.

It should be understood that the invention is not limited in its application to the details of construction and the arrangements of the components set forth in the following description or illustrated in the above-described drawings. The invention is capable of other embodiments and of being practiced or being carried out in various ways.

DETAILED DESCRIPTION

FIGS. 1-11 illustrate the various items contained within a reusable signage system or kit 10. The kit 10 contains the materials necessary to create, store, and display multiple, reusable label assemblies 14, each of which can be used to identify a particular food item in a buffet. The label assemblies 14 are configured to be easily created, applied, removed, and re-applied, as necessary, so the signage can be altered to correspond to the food items present for a particular meal. In the present invention, the kit 10 includes multiple sheets of label stock 18, a plurality of dome covers 22, a storage apparatus or binder 26, a label removal tool 30, and various forms of backing plates 34. Although the present invention includes each of the above items, in alternate constructions, more or fewer items may be included in the kit 10 as necessary.

In the illustrated construction, each label assembly 14 includes an individual label 38 from the stock 18 (described below) and a dome 22 coupled to the label 38. During use, the label assembly 14 acts as a unit, whereby the label 38 and dome 22 are placed on, and removed from, a support surface together. In alternate constructions, each label assembly 14 may include additional layers, such as supplemental domes 22, labels 38, and the like, to produce a desired aesthetic appearance.

Figure 4:
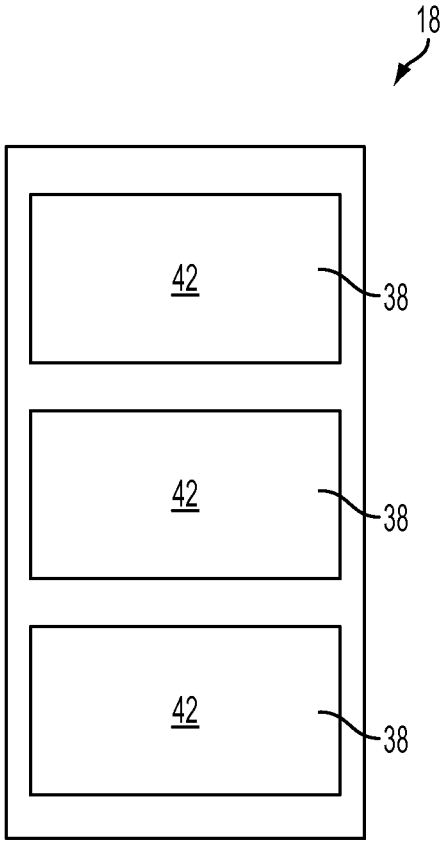
FIG. 4 is a front view of a piece of label stock.
Figure 5:
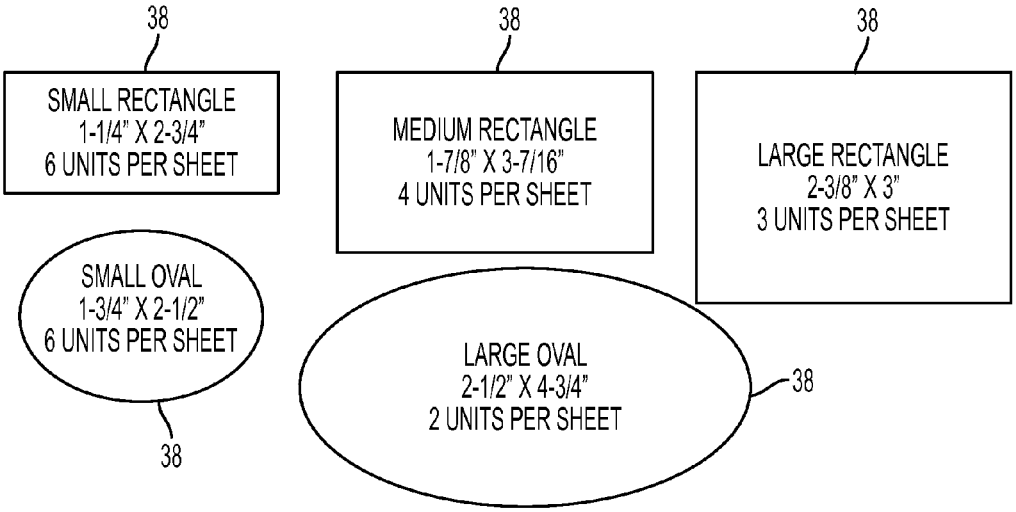
FIG. 5 illustrates various sizes and shapes of the labels.
Figure 6:
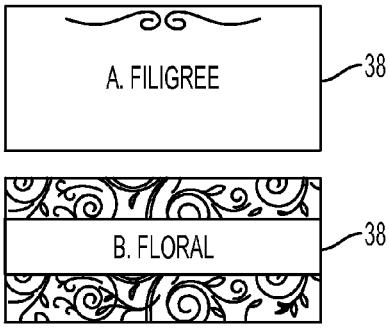
FIG. 6 illustrates various patterns that may be pre-printed on a label.

Illustrated in FIG. 4, the stock 18 is preferably a piece of Mylar (PET) that has been coated with a print receptive coating, however in alternate constructions, other forms of adhesive sheeting may be used. The stock 18 includes a top surface 42 and a bottom surface 46 opposite the top surface 42. The stock 18 is formed from material having the proper size, shape, thickness, and flexibility for use in most common desktop printers, such as an inkjet or laser style printer. To aid the printing process (described below) the stock 18 is typically formed in one of the many standardized paper stock sizes, such as, but not limited to, #10 Envelope, A4, Legal, Letter, and the like. When available, the stock 18 is preferably sized so it can be fed through the straight pass portion of a printer, eliminating unnecessary bending of the stock 18 and minimizing the chances of jamming the printer.

The top surface 42 of the stock 18 is treated or coated so that indicia, such as logos, text, pictures, and the like may be printed thereon, preferably with a standard desktop printer. The stock 18 illustrated herein includes a plain, unmarked top surface 42, however, in alternate embodiments, the top surface 42 may include preprinted designs, logos, pictures, patterns, backgrounds, and the like (see FIG. 6). Furthermore, the stock 18 may be formed from colored or textured material to create a desired aesthetic appearance. In still other constructions, clear or translucent material may be used for the stock 18.

The bottom surface 46 of the stock 18 (see FIG. 3) has a reusable, pressure-sensitive adhesive applied thereon. Each label 38 may be peeled from a backing layer (not shown) or other release material and stuck to any one of a backing plate 34, a saver binder page 66 (described below), an acrylic sneeze guard (not shown), or additional materials having a glossy, non-porous surface, such as metal, painted surfaces, wood, plastic, and the like. In the present invention, the reusable, pressure-sensitive adhesive is formulated such that a corresponding label 38 may be applied, removed, and re-applied multiple times (e.g., upwards of 100 cycles) to various surfaces before the adhesive begins to degrade. It is also preferred that the label 38 can be removed cleanly from the substrate to which it has been attached without damaging or leaving gooey, dirty, stained, or otherwise undesirable texture on the substrate.

The stock 18 is typically die-cut into multiple labels 38, each of which can be individually removed and applied. The labels 38 are preferably cut into standard sizes and shapes and may include, but are not limited to squares, ovals, circles, and the like (see FIG. 5). It is preferred that the labels 38 are cut into the stock 18 in a way that maximizes the number of labels 38 that can be produced from a particular sheet of stock 18, thereby minimizing waste. In alternate constructions, the labels 38 may form unique shapes, such as thematic designs (e.g., animals, flowers, hearts, etc.), logos, symbols, letters, numbers, or the like, for a more customized look. In still other constructions, the stock 18 may remain uncut to form a single label 38.

Figure 2:
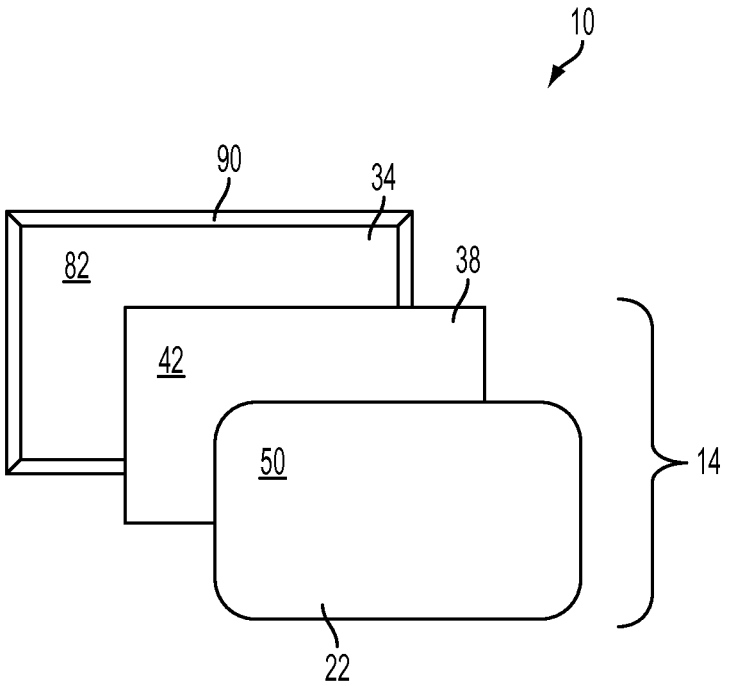
FIG. 2 is an exploded view of the label assembly and backing plate of FIG. 1.
Figure 3:
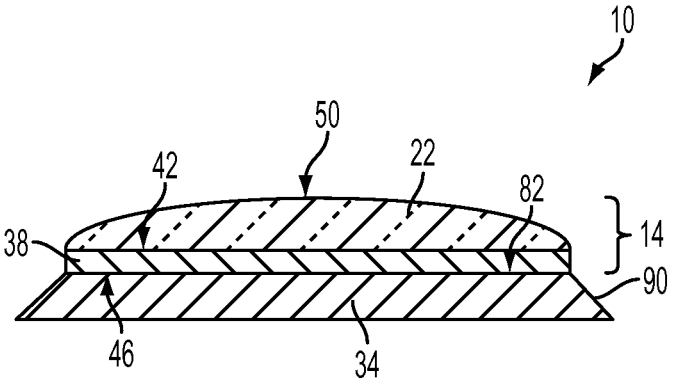
FIG. 3 is a section view taken along line 3-3 of FIG. 1.

Illustrated in FIGS. 1-3, each dome cover 22 is a piece of substantially transparent material which may be attached to the top surface 42 of a corresponding label 38 to provide rigidity and protect any indicia on the top surface 42. Each dome 22 is generally formed from plastic (such as epoxy, a mixture of urethanes, or the like) and includes a pressure-sensitive adhesive on the underside thereof. This adhesive typically has stronger holding capability than the adhesive used on the bottom surface 46 of the stock 18. The plastic material of the dome 22 should be sufficiently transparent so that, when the dome 22 is coupled to the label 38, any indicia printed on the top surface 42 can be clearly seen through the dome 22 without excessive distortion or obfuscation. Furthermore, the plastic material used for the dome 22 should be strong enough to resist breaking, hard enough to resist scratches, and should not discolor over time. The adhesive portion of the dome 22 is typically attached to a suitable sheet of release paper (not shown) or other form of backing from which the domes 22 can be easily peeled away for application to the top surface 42 of a label 38.

The domes 22 are typically formed in a shape substantially corresponding to the shape of the label 38 to which they are to be adhered. The upper surface 50 of the domes 22 as illustrated with a somewhat rounded surface, however, the domes 22 may have any suitable shape consistent with the objects of the invention. Thus, the domes 22 may be flat, rounded, or have an uneven or textured surface. In addition to rigidity and protection, the domes 22 may also provide special effects (such as pearlescence, magnification, and the like). In some constructions the domes 22 may be pastel amber, blue, green or the like. In still other constructions, the domes 22 may have a logo, a design, or a pattern preprinted thereon.

Figure 7:
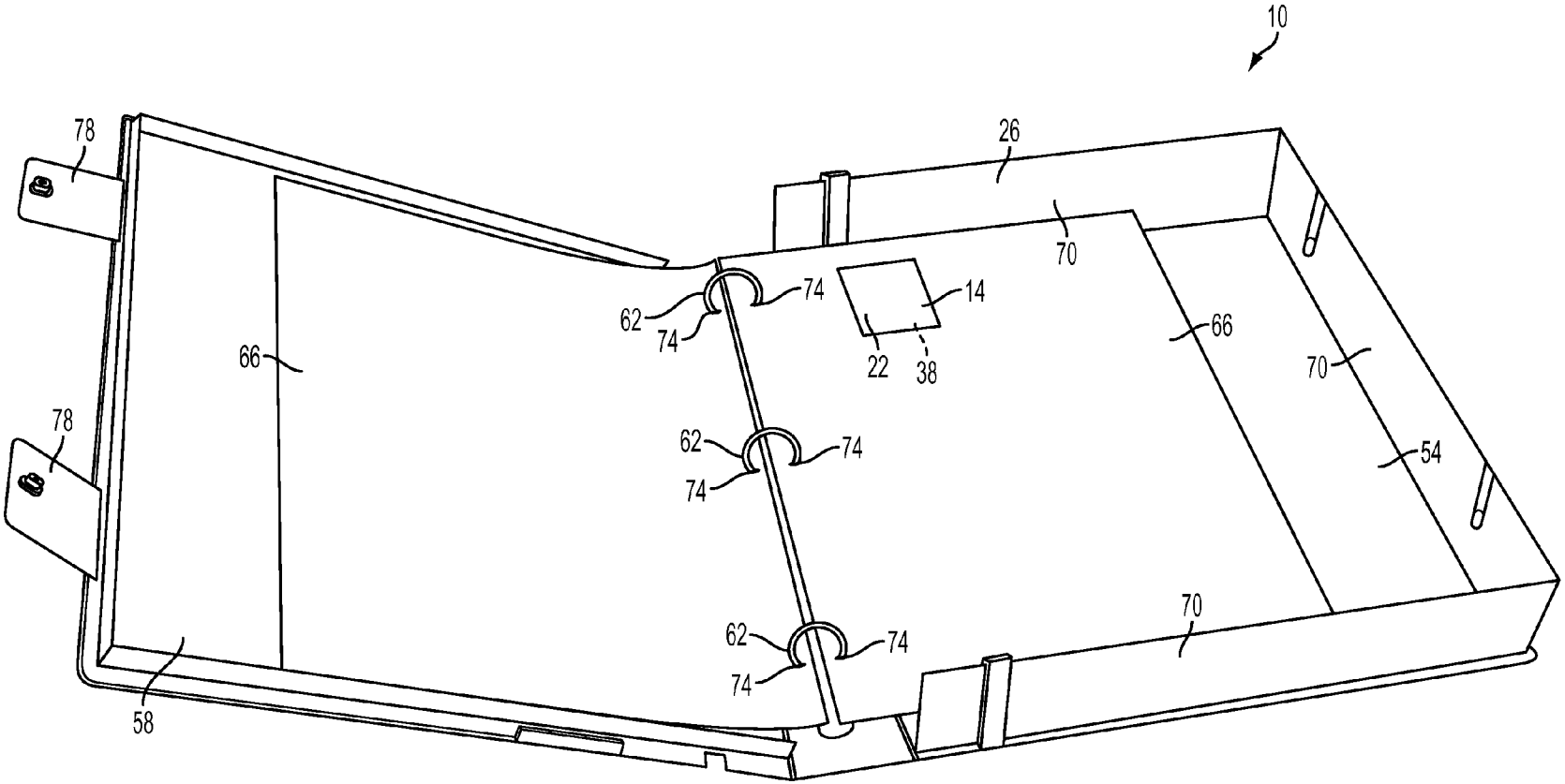
FIG. 7 is a perspective view of a storage binder for the label assemblies.

Illustrated in FIG. 7, the kit 10 also includes a storage apparatus or binder 26 for storing the unused or surplus label assemblies 14 when not in use. The binder 26 includes a bottom cover 54, a top cover 58 moveable with respect to the bottom cover 54, a plurality of locking rings 62 positioned between the top and bottom covers 54, 58, and a plurality of pages 66 positioned therein. The locking rings 62 of the binder 26 are preferably spring-loaded (much like a typical 2-ring or 3-ring binder), and are configured to be received within apertures 74 defined by the pages 66. Furthermore, the locking rings 62 may be opened and closed by the user to add, remove, or re-arrange the pages 66 of the storage apparatus 26, as necessary. The binder 26 also includes side walls 70 to allow the interior of the binder 26 to be substantially sealed from dust and dirt to help preserve the label assemblies 14 stored therein. The binder 26 may include one or more locking tabs 78 to lock the binder 26 when not in use.

Each page 66 of the binder 26 includes one or more apertures 74, each corresponding to a locking ring 62 of the binder 26. The pages 66 also include at least one coated or glossy surface to which the label assemblies 14 can be applied between uses without damaging or excessively deteriorating the reusable adhesive. In the present invention, the pages 66 include a PVC coating.

In some constructions, the binder 26 is organized such that the labels 14 can be easily located and categorized. More specifically, the binder 26 may include locating tabs, dividers, pockets, and the like (not shown). The binder 26 may also include storage provisions for other aspects of the kit 10, including but not limited to, an instruction manual, the backing plates 34, the removal tool 30, the stock 18, the dome covers 22, and the like.

Illustrated in FIGS. 1-3 and 8-9, the kit 10 also includes one or more backing plates 34 to which one or more label assemblies 14 may be adhered to for rigidity and display. Each backing plate 34 includes a display surface 82 for the label assemblies 14. This surface is preferably smooth and glossy and constructed so that it will not excessively deteriorate the re-usable adhesive of the label assemblies 14. The backing plates 34 are typically coupled to a frame 86 (described below) or other form of support (e.g., a sneeze guard, a wall, a table, and the like) by any one of, but not limited to, double sided tape, magnetic tape, suction cups, reusable pressure-sensitive adhesive, cling foam, or other suitable fastening means. When adhesives are used, the holding power of the backing plate adhesive is preferably greater than that of the adhesives found on the stock 18 and the dome cover 22. Typically, the backing plates 34 are positioned so that the display surface 82, and any label assemblies 14 adhered thereto, will be located in a prominent, easy to see place. In alternative constructions, the backing plates 34 may be permanently coupled to a supporting surface through appropriate fastening means.

The backing plate 34 may include a beveled edge 90 stamped or otherwise formed into the plate 34 along at least a portion of the periphery to give the backing plate 34 a finished and aesthetically pleasing look. The backing plate 34 may also include logos, patterns, textures, and the like, which may be carved, pressed, molded, or otherwise formed on the plate 34.

Each backing plate 34 is formed from a substantially rigid material (e.g., metal, acrylic or other plastic materials) and is typically polished or coated to a jewel-like finish. The backing plate 34 is preferably formed in a typical shape, such as a rectangle, oval, or circle, or it may have a less typical form;

and it may or may not correspond to the shapes of the corresponding label assemblies 14 (see FIG. 1). The backing plate 34 may also be formed in unique shapes, such as numbers, letters, logos, animals, etc.

Figure 8A:
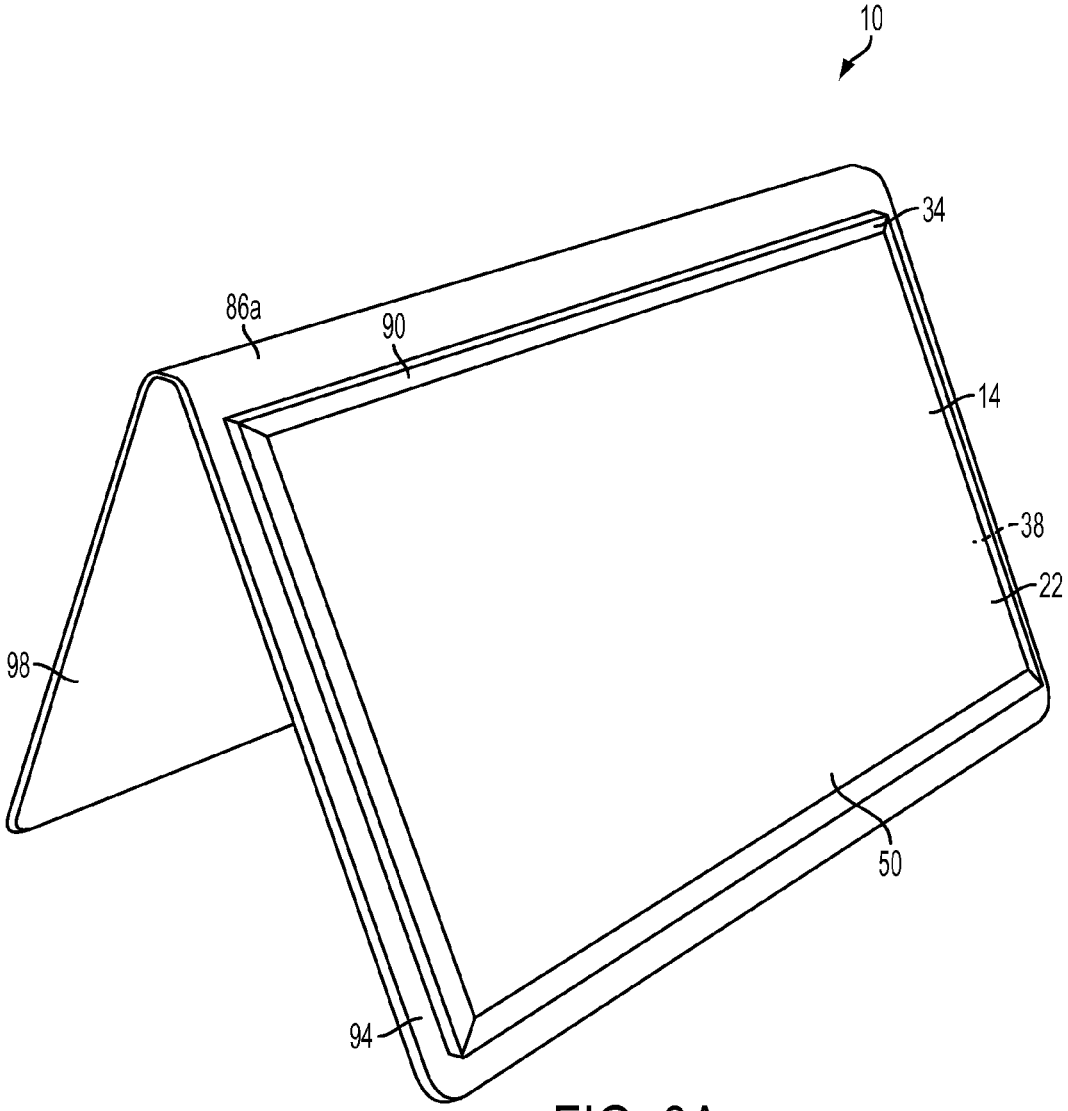
FIGS. 8*a*-8*b* illustrate a frame with a label assembly and backing plate coupled thereto.
Figure 8B:
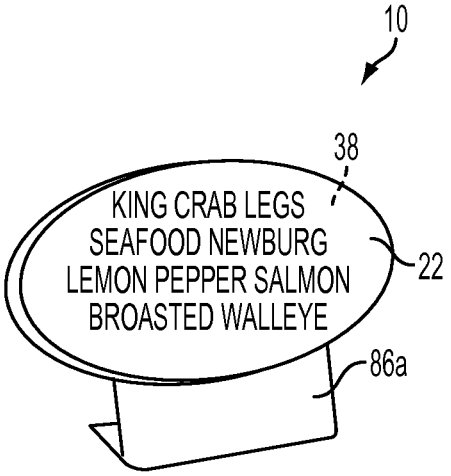

As shown in FIG. 8*a* a frame 86*a* is shown, which is a self-supporting structure, which can be placed upon a substantially horizontal surface (e.g., a table top) to position the corresponding label assembly 14 in a substantially vertical or upright position. For example, illustrated in FIG. 8*a*, the frame 86*a* includes a substantially "inverted-V" shape having a first leg 94, a second leg 98, placed at an angle with respect to the first leg 94, and a backing plate 34 coupled to the first leg 94 (as described above) for display. Alternatively, the backing plate 34 may be formed integrally with the first leg 94 of the frame 86*a*. In another construction, a backing plate 34 may be coupled to both the first and second legs 94, 98. Also, the frame 86*a* may include alternate forms and shapes (e.g., cube-shaped, pyramid-shaped, etc.).

Figure 9:
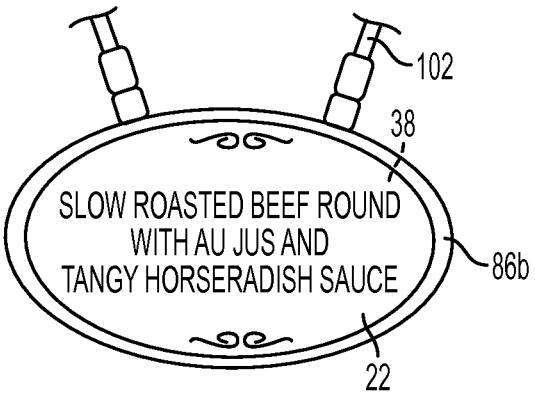
FIG. 9 illustrates an alternative embodiment of the frame with a label assembly and backing plate coupled thereto.

FIG. 9 shows a second embodiment of the frame 86*b*. Here, the frame 86*b* is configured to be hung from an object such as a hook, door knob, and the like. For example, as illustrated in FIG. 9, the frame 86*b* includes a chain or loop of material 102 coupled to the backing plate 86*b*. In still other constructions, the frame 86*b* may include a hook, clamp, or lanyard.

Figure 10:
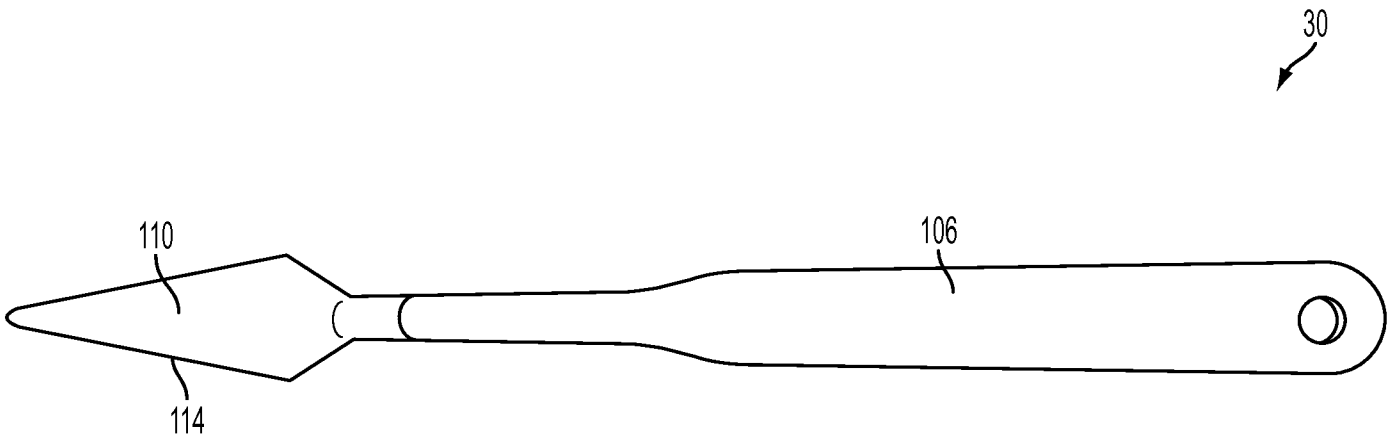
FIG. 10 is a top view of a tool for removing the labels shown in the previous Figs.
Figure 11:
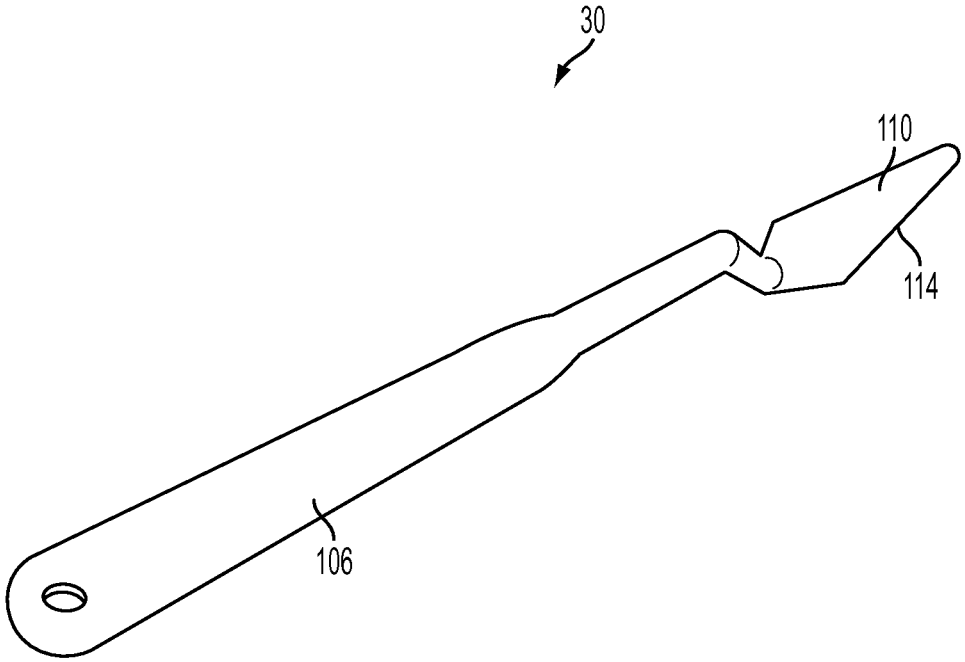
FIG. 11 is a perspective view of the tool of FIG. 10.

As illustrated in FIGS. 10 and 11, the kit 10 also includes a removal tool 30, which includes a handle portion 106, and a blade portion 110, extending from the handle portion 106. The blade portion 110 is shaped and contoured such that it can be positioned (e.g., wedged) between the label assembly 14 and the surface to which the label assembly 14 is adhered (e.g., a backing plate 34, sneeze guard, and the like) to separate the two items without excessively damaging the adhesive on the bottom surface 46 of the label 38. The blade portion 110 includes a beveled edge 114 along at least a portion of its periphery, which allows the edge to be easily inserted between the items. In the illustrated construction, the blade portion 110 is substantially diamond shaped, but various other suitable shapes can be used where desired.

Although not illustrated, the kit 10 may also include the rights to use, or an electronic copy of, a computer software program for generating the text and graphics (hereafter "badge indicia") for the top surface 42 of the labels 38. The program enables a user to generate and print customized badge indicia and apply it to a piece of stock 18 through a desktop printer. The program uses profile files to define the content and layout of the badge indicia. The content includes text fields and image fields (e.g., quantity and type of each). The layout includes the positioning and size of the fields, as well as the font of the text fields on the top surface 42 of the stock 18. The profile files are provided by the manufacturer or can be created by a user via a profile creation program. A user inputs data (e.g., name, department, etc.) into the program for a plurality of badges based on a chosen profile. The entered data can be saved, merged, or exported to memory (e.g., a hard drive). The data then can be printed onto the stock 18. Additional details of the software program can be found in U.S. patent application Ser. No. 12/718,827, the contents of which are hereby incorporated by reference.

Figure 13:
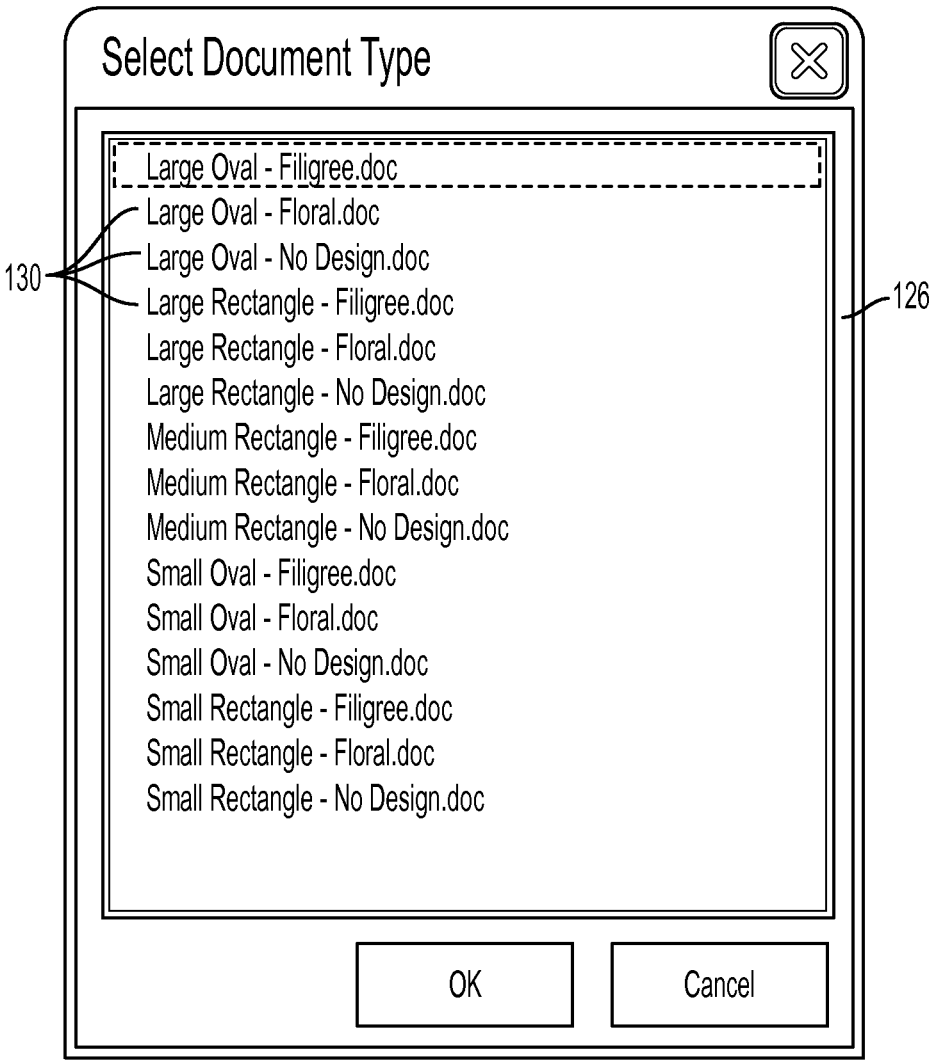
FIG. 13 is a screen shot of a "Select Document Type" window of the software program of FIG. 12.
Figure 14:
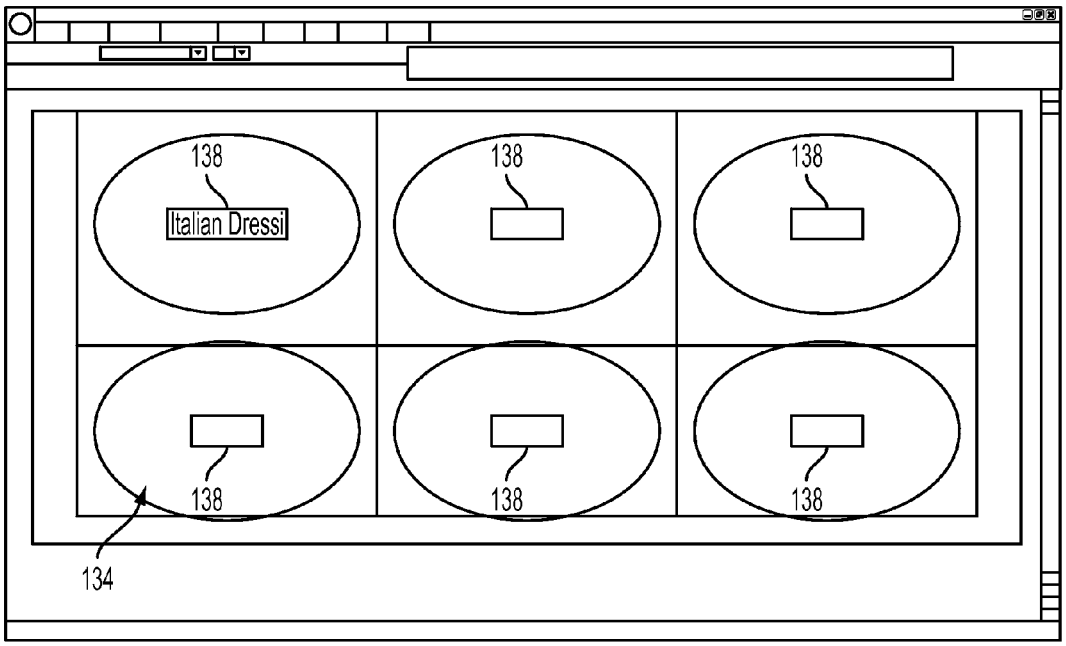
FIG. 14 is a screen shot of a blank template of the software program of FIG. 12.

To create customized badge indicia, the user first opens the appropriate word processing program (e.g., Microsoft® Word). The user then right-clicks on the screen causing a submenu 118 to open (see FIG. 12). The user mouses down to the "Cling [Label] Print" selection causing a secondary submenu 122 to open. The user selects "New Document" from the secondary submenu 122, thereby causing a "New Document Type" window 126 to open. Window 126 lists a number of pre-fabricated or user-fabricated document templates 130 (see FIG. 13). After the user selects a template style that generally corresponds to the stock 18 loaded into the printer, a blank label template 134 will open (see FIG. 14). The user may then enter the proper information into the relevant entry locations 138. Once complete, the user may choose to print the created badge indicia onto the stock 18 or save the document for future use.

Figure 12:
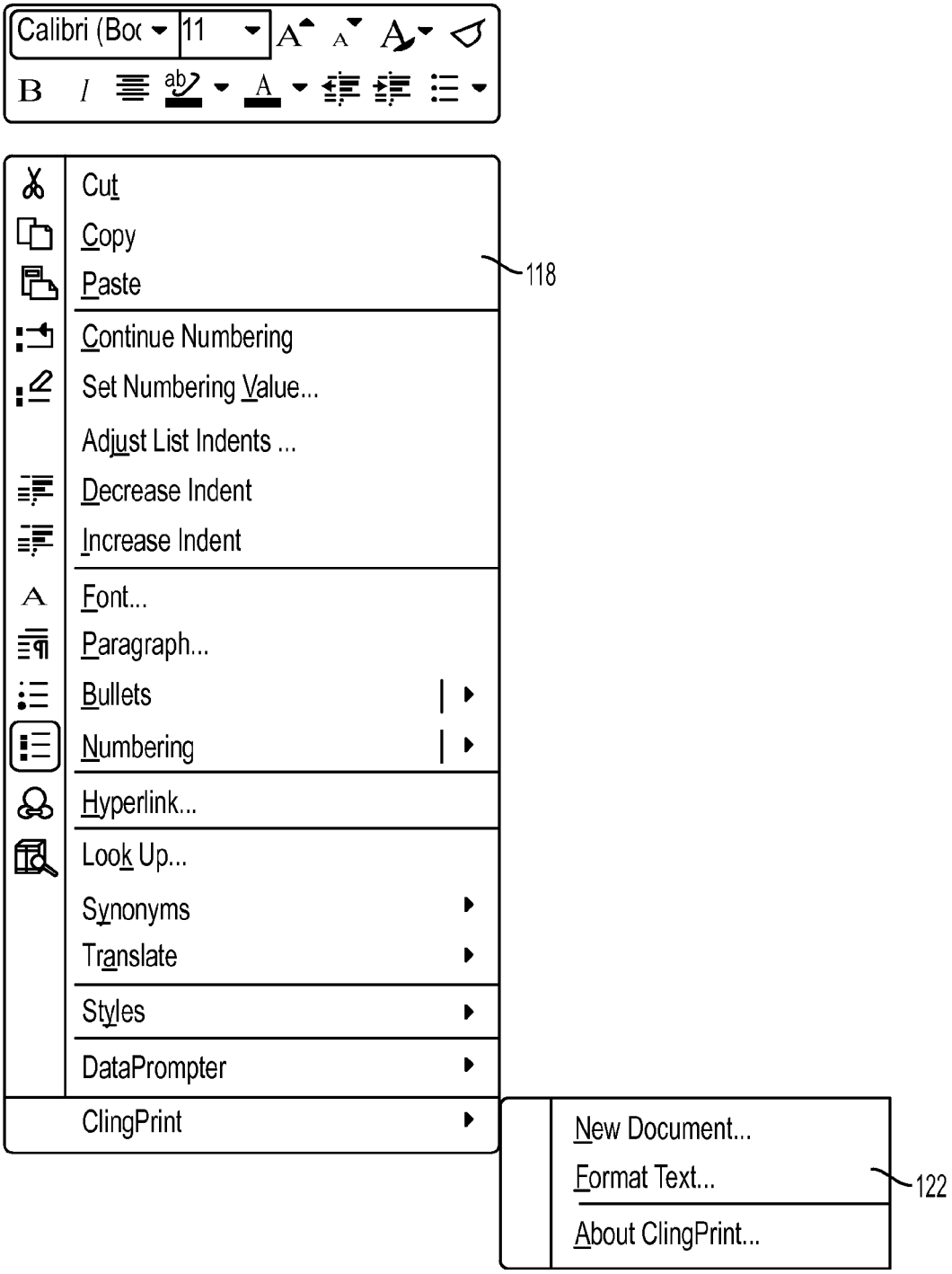
FIG. 12 is a screen shot of a submenu of one embodiment of a software program for printing on the labels shown in the previous FIGS.
Figure 15:
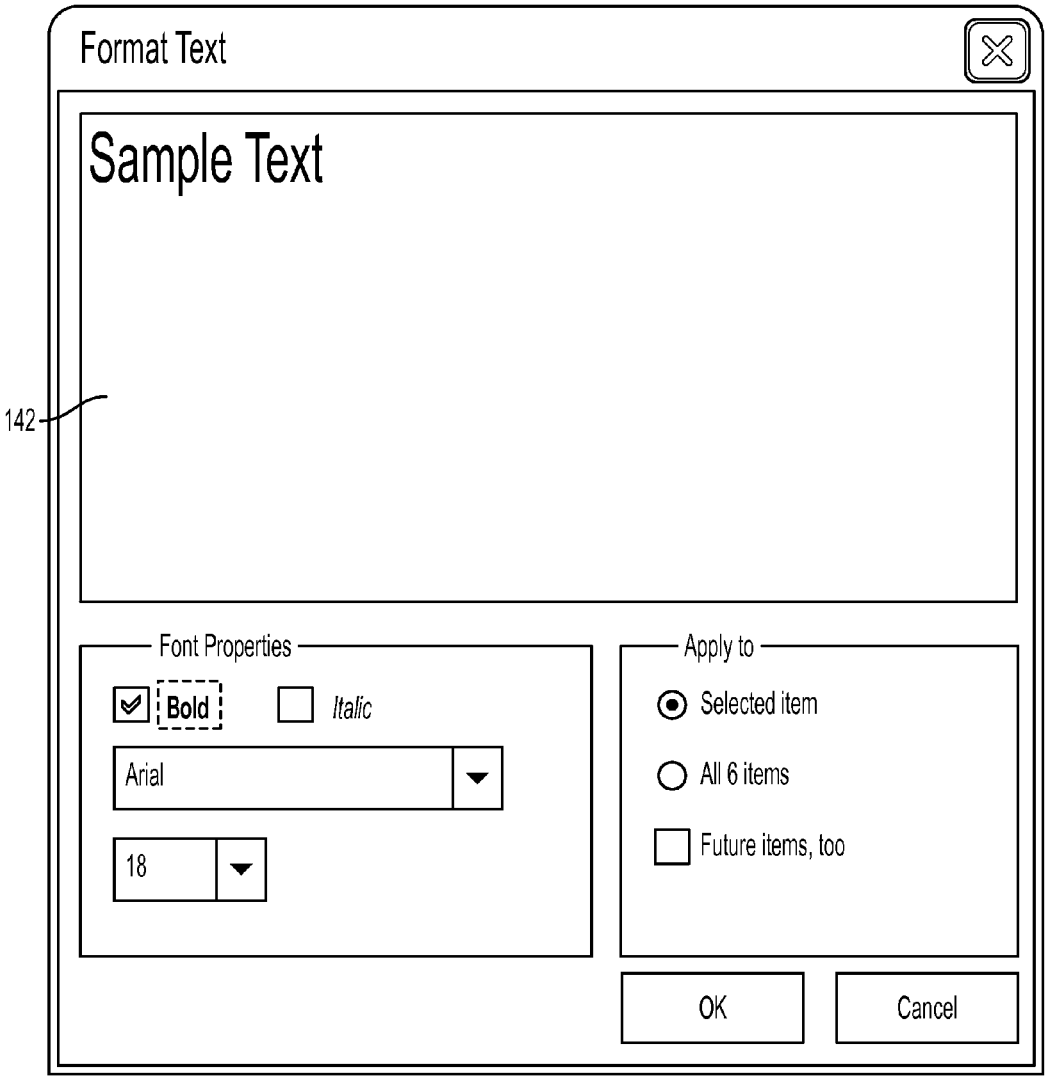
FIG. 15 is a screen shot of a "Format Text" window of the software program of FIG.

To modify the format of the text, the user right-clicks on the screen causing submenu 118 to open (see FIG. 12). The user then mouses down to the "Cling [Label] Print" selection, causing a secondary submenu 122 to open. The user selects "Format Text" from the secondary submenu 122, causing a "Format Text" window 142 to open (see FIG. 15). The user may then change various text properties, such as, but not limited to bold type, italics, underline, font, size, and the like. The user then selects "OK" to apply the changes to the selected text.

To print badge indicia onto a label 38, a standard desktop printer is set to accept the size of the cling stock 14 (e.g., #10 Envelope). The cling stock is loaded into the printer, making sure to properly orient the stock 14 so that the badge indicia will be printed onto the top surface 42. The user uploads, creates, or otherwise prepares the badge indicia for printing onto the top surface 42 of the stock 18. While creating the badge indicia, the user may utilize any number of pre-existing computer programs (e.g., Microsoft Word, Print Shop, and the like) or the user may utilize the above-described software program when available to properly position and size the text. The stock 18 is fed through the printer and the badge indicia is printed onto the top surface 42 of each of the corresponding labels 38. It is not necessary to print badge indicia on every label 38 of a particular piece of stock 18 in a single pass. Rather, the user may save the remaining or unused labels 38 for use at a later time.

To cover the printed labels and thereby form the label assembly 14, the user selects a dome 22 corresponding to the size and shape of the label 38 they wish to cover. The selected dome 22 is removed from a backing sheet (not shown) and aligned with the label 38 using the die-cut lines as guides. The dome 22 is applied to the top surface 42 of the label 38, making sure to eliminate any air bubbles as the two are adhered to one another, thereby creating a label assembly 14.

To apply the label assembly 14 to a support surface (such as a backing plate 34, a page 66 of the binder 26, or a sneeze guard), the label assembly 14 is removed gently from the release paper in a manner that assures that excessive stretching or otherwise excessive handling of the media is avoided. Then the label assembly 14 is aligned with the surface to which it is to be applied and care is taken to make sure that the surface is clean by the removal of any grease, residue, soot, or dust that may be present. The label assembly 14 is then applied to the surface.

To remove the label assembly 14 from a surface, the blade portion 110 of the removal tool 30 is placed proximate to an edge of the label assembly 14, and the blade is slid between the bottom surface 46 of the label assembly 14 and the surface to which the label 14 is adhered. The tool is gently moved towards the center of the label assembly 14 so that it peels the label assembly 14 from the surface without damaging the label 14. Once a sufficient amount of the label assembly 14 is peeled away, it may be grasped by the edges and removed entirely from the surface.

The invention claimed is:

1. A kit for creating reusable label assemblies having indicia thereon, the kit comprising:

one or more sheets of label stock collectively defining a plurality of labels, where at least one label differs from another label of the plurality of labels by at least one of size or shape, a bottom surface of the one or more sheets of label stock including a reusable adhesive having a first holding capability;

a plurality of dome covers, each being formed of a substantially transparent material and having an underside, wherein a layer of a second adhesive is coated on the underside, the second adhesive being a pressure-sensitive adhesive having a second holding capability greater than the first holding capability, and wherein at least one dome cover differs from another dome cover of the plurality of dome covers by at least one of size or shape;

at least one backing plate; and a storage apparatus.

2. The kit of claim 1, wherein the storage apparatus includes a binder, wherein the binder includes the at least one page, and wherein each page includes at least one coated or glossy surface.

3. The kit of claim 1, further comprising a label removal tool, and wherein the label removal tool includes a handle and a blade.

4. The kit of claim 1, wherein at least a portion of the backing plates are coupled to a frame.

5. The kit of claim 4, wherein the frame includes at least one of a self supporting structure and a chain.

6. The kit of claim 1, further comprising an electronic copy of a software program for generating the indicia.

7. A method of creating a reusable label assembly configured to be removably coupled to a support surface, the method comprising:

placing one or more sheets of label stock in a printing apparatus, a bottom surface of the one or more sheets of label stock including a reusable adhesive having a first holding capability between the adhesive and the support surface;

printing indicia on the top surface of the one or more sheets of label stock;

dividing the one or more sheets of label stock into a plurality of labels, wherein at least one label differs from another label of the plurality of labels by at least one of size or shape;

providing a plurality of dome covers, each dome cover being formed of a substantially transparent material and having an underside, wherein a layer of a second adhesive is coated on the underside, the second adhesive being a pressure-sensitive adhesive having a second holding capability greater than the first holding capability, and wherein at least one dome cover differs from another dome cover of the plurality of dome covers by at least one of size or shape; and applying a dome cover of the plurality of dome covers to a top surface of a corresponding label of the plurality of labels to create a label assembly.

8. The method of claim 7, wherein dividing the one or more sheets of label stock into a plurality of labels includes die cutting at least one page of the label stock.

9. The method of claim 7, wherein applying a dome cover includes applying a dome cover having a size and shape substantially corresponding to the size and shape of the corresponding label.

10. The method of claim 7, further comprising:

removing the label assembly from the label stock; and applying the surface of the label assembly having the reusable adhesive to a backing plate.

11. The method of claim 7, further comprising exposing the reusable adhesive on a back surface of an individual one of the multiple labels.

12. The method of claim 7, wherein applying the dome cover includes permanently attaching the dome cover to the corresponding label with the second adhesive, the second adhesive being a permanent adhesive.

* * * * *